United States Patent [19]

Yui et al.

[11] Patent Number: 4,630,918

[45] Date of Patent: Dec. 23, 1986

[54] IMAGE COMPENSATING METHOD IN A COPYING MACHINE

[75] Inventors: Yuhi Yui, Nara; Hiroshi Kinashi, Uji, both of Japan

[73] Assignee: Sharp Kabushiki Kaisha, Osaka, Japan

[21] Appl. No.: 743,650

[22] Filed: Jun. 11, 1985

[30] Foreign Application Priority Data

Jun. 11, 1984 [JP] Japan ..... 59-121009

[51] Int. Cl.[4] ..... G03G 15/00

[52] U.S. Cl. ..... 355/3 R; 355/3 DD; 355/14 E; 355/14 D

[58] Field of Search ..... 355/14 D, 14 E, 3 DD, 355/3 R

[56] References Cited

U.S. PATENT DOCUMENTS 4,256,401 3/1981 Fujimura et al. ..... 355/14 D

FOREIGN PATENT DOCUMENTS 0068766 4/1983 Japan ..... 355/14 D

*Primary Examiner*—A. T. Grimley
*Assistant Examiner*—David Warren
*Attorney, Agent, or Firm*—Birch, Stewart, Kolasch & Birch

[57] ABSTRACT

Image intensity adjustment in a copying machine is performed by simultaneously adjusting both a bias voltage to be applied to a developer unit of the copying machine and the intensity of light to be projected at an exposure section onto a photosensitive medium of the copying machine. Adjustment is facilitated by operatively connected variable resistors.

8 Claims, 4 Drawing Figures

IMAGE COMPENSATING METHOD IN A COPYING MACHINE

BACKGROUND OF THE INVENTION

The present invention generally relates to an image compensating method in a copying machine and, more particularly, to a method for compensating the image developed by a copying machine by simultaneously adjusting both the intensity of light to be projected onto a photosensitive medium and the bias voltage to be supplied to a developer unit.

In order to provide an acceptable copy of an image, it is a conventional practice to independently adjust the intensity of light projected onto the photosensitive medium at the exposure section according to an original or document bearing an image to be reproduced, and adjust the bias voltage to be supplied for the development of the image, to thereby provide compensation for the image being reproduced. Where only the intensity of light projected onto the photosensitive medium is adjusted, a phenomenon occurs in which strokes of characters tend to be reproduced undesirably thick in a low illumination area under the influence of flare, whereas where only the bias voltage is adjusted, a poor copy of the image will be produced from the original because the concentration of a so-called totally blackened area varies.

In order to obviate the above discussed problems inherent in the image compensating methods, Japanese Laid-open Patent Publication No. 58-68766 discloses the image compensating method wherein a single image adjusting dial is utilized for adjusting the intensity of light emitted by an illuminator lamp when turned a certain angle and for adjusting the bias voltage when turned the other angle. However, it has been found that, according to the prior art method disclosed in the above mentioned publication, since the extent to which the image can be compensated when the adjusting dial is turned within the range of angle for changing the intensity of light emitted by the illuminator lamp differs from that when the same adjusting dial is turned within the other range of angle for changing the bias voltage, an acceptable copy of the image cannot always be obtained depending on the type of original or document bearing an image to be copied.

SUMMARY OF THE INVENTION

Accordingly, the present invention has been developed with a view to substantially eliminating the above described problems and has for its essential object to provide an improved image compensating method wherein a relatively large latitude of adequate compensation of the image to be reproduced can be accomplished merely by turning a single image adjusting dial.

This can be, according to the present invention, attained by the simultaneous adjustment of the intensity of light projected onto the photosensitive medium and the bias voltage used for the image development in a copying machine.

BRIEF DESCRIPTION OF THE DRAWINGS

This and other objects and features of the present invention will become clear from the following description taken in conjunction with a preferred embodiment with reference to the accompanying drawings, in which.

DETAILED DESCRIPTION OF THE EMBODIMENT

Figure 1:
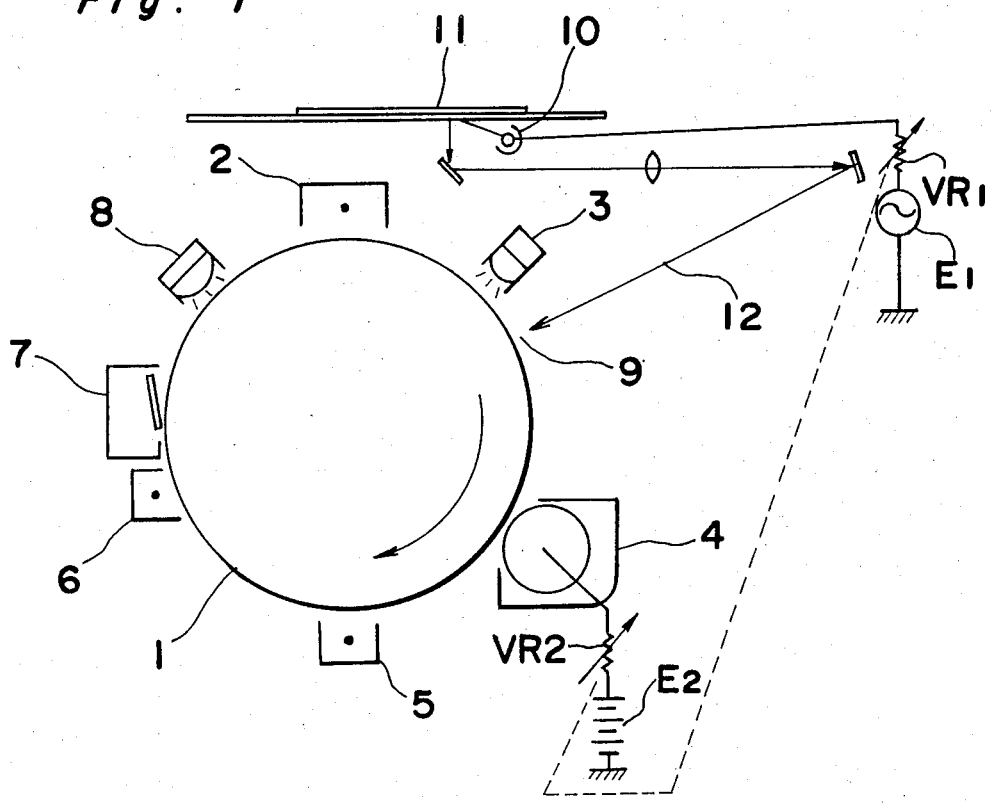
FIG. 1 is a schematic diagram showing a copying machine embodying the present invention.

Referring first to FIG. 1, a copying machine schematically shown therein comprises a rotatably supported photoreceptor drum 1 around which, in a given order with respect to the direction of rotation of the photoreceptor drum 1, there is fixedly disposed a charger 2, an erasing lamp 3, a developer unit 4, a transfer unit 4, a discharge 6, a cleaner unit 7 and a discharging lamp 8. Around the drum 1 and between the eraser lamp 3 and the developer unit 4, there is formed an exposure section 9 through which imagewise light 12 is emitted from an illuminator lamp 10 and then reflected from an original on a document holding plate 11 and, subsequently, by way of a projector lens assembly and reflecting mirrors guided onto the photoreceptor drum 1.

The intensity of light emitted by the illuminator lamp 10 for the illumination of the original on the document holding plate 11 can be adjusted by adjusting a variable resistor VR1 connected between the illuminator lamp 10 and a source of alternating current E1. As the voltage increases, the lamp 10 becomes brighter, thereby intensifying the light. When the light intensity from the lamp becomes strong, the voltage of the drum surface becomes low. Accordingly, the voltage difference between the drum surface and the unit 4 becomes smaller, resulting in the brighter image of the copy. On the other hand, the bias voltage applied to the developer unit 4 can be adjusted by adjusting a variable resistor VR2 connected between the developer unit 4 and a source of direct current E2. According to one embodiment, such as indicated by line **2-*b* in FIG. 2**, the bias voltage may change from +100 to +300 volts.

When the bias voltage is +100 volts, a voltage difference between unit 4 and the surface of drum 1 (having a voltage such as +800 volts) is 700 volts. On the contrary, when the bias voltage is +300 volts, the voltage difference between unit 4 and the surface of drum 1 is 500 volts.

More developer, such as toner, will be used as the voltage difference between unit 4 and drum surface becomes greater. Accordingly, more developer will be used when the bias voltage is +100 volts than when it is +300 volts. Thus, the copied image becomes brighter as the bias voltage increases.

Although not shown, the variable resistors VR1 and VR2 for the adjustment of the light intensity at the exposure section 9 and adjustment of the bias voltage, respectively, are operatively connected so that, when a single common image adjusting dial is turned, both can be simultaneously adjusted. The variable resistors VR1 and VR2 may be mounted on the same shaft, geared or chained together, or interconnected in any manner so as to be simultaneously varied. It is to be noted that the image adjusting dial for both of the variable resistors VR1 and VR2 has graduations numbered No. 1 to No. 5 corresponding respectively to different resistance settings of both of these variable resistors VR1 and VR2 so that, by turning the only image adjusting dial, both of the variable resistors VR1 and VR2 can be simultaneously set to respective resistances required to given an optimum reproduced image regardless of whether the original is printed light or whether it is printed dark.

Figure 2:
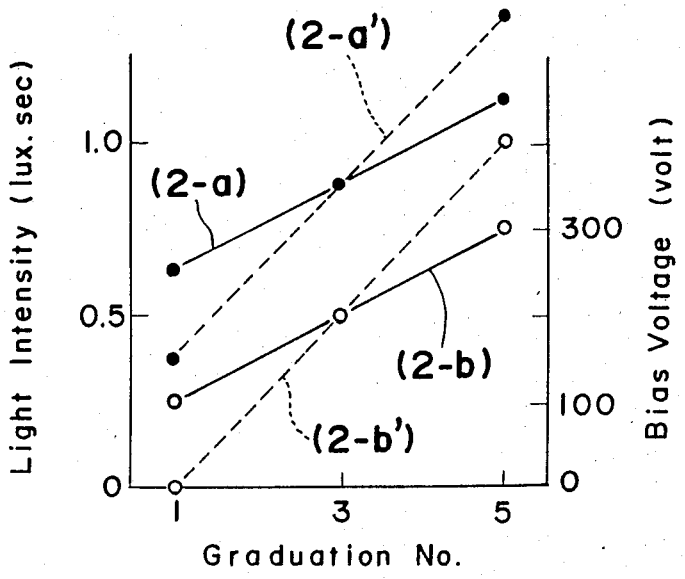
FIGS. 2 to 4 are graphs showing respective comparisons between characteristics produced when an image adjusting dial of an image compensating device of the present invention has been adjusted and those produced when the prior art image adjusting device has been adjusted.

When the image adjusting dial is turned to graduation No. 1 position, the bias voltage will be set to about +100 volts and the voltage for the light intensity will be so set as to produce the light intensity of about 0.6 lux. sec (FIG. 2). Then, when the dial is turned to graduation No. 5 position, the bias voltage will be set to about +300 volts and the voltage for the light intensity will be so set as to produce the light intensity of about 1.1 lux. sec (FIG. 2). When the dial is at the graduation No. 5 position, the bias voltage is higher when compared with the case when the dial is at the graduation No. 1 position. Therefore, the voltage difference between the unit 4 and the drum surface is smaller and a brighter image of the copied paper will result. Also, when the dial is at the graduation No. 5, the light intensity from the lamp is stronger. Thus, the voltage at the drum surface will be lower than the case when the dial is at the graduation No. 1. This will also result in a brighter image of the copied paper.

Accordingly, by the change of graduation No. to a greater number, the change in the bias voltage and the change in the light intensity will together cause the copied paper to become brighter, i.e., with less contrast.

After the photosensitive surface of the photoreceptor drum 1 has been charged by the charger 2, an electrostatic latent image corresponding to the image to be copied is formed thereon by the eraser lamp 3 and the imagewise light 12. As the drum 1 is rotated and passes in front of the developer unit 4, the latent image is developed into a visible powdered image which is subsequently transferred by the transfer unit 5 onto a copy paper fed in synchronism with the rotation of the drum 1.

With the powdered image having been transferred onto the copy paper, toner particles remaining on the photoreceptor drum 1 are, after having been discharged by the discharger 6, cleaned by the cleaner unit 7 and the residue electrostatic charge on the photoreceptor drum 1 is subsequently completely removed by the discharging lamp 8 in readiness for the next cycle of copying operation. The compensation of the image to be copied according to the original image in the original placed on the document holding plate 11 can be achieved by the simultaneous adjustment of the variable resistors VR1 and VR2 which is achieved by turning the image adjusting dial to any one of the dial graduations No. 1 to No. 5.

The characteristics developed when the image adjusting dial according to the present invention has been adjusted will now be described, as compared with those given by the prior art method wherein either the intensity of light at the exposure section or the bias voltage is adjusted.

Referring to FIG. 2, there is shown a graph, the axis of abscissa of which represents the dial graduation of the image adjusting dial whereas the axis of ordinates represents the intensity of light at the exposure section and the bias voltage. In the graph of FIG. 2, the solid line 2-*a* represents a change in intensity of light relative to the position of the image adjusting dial according to the present invention, whereas the broken line 2-*a'* represents a change in intensity of light relative to the position of the image adjusting dial according to the prior art method wherein only the intensity of light at the exposure section is adjustable. The solid line 2-*b* represents a change in bias voltage relative to the position of the image adjusting dial according to the present invention, whereas the broken line 2-*b'* represents a change in bias voltage relative to the position of the image adjusting dial according to the prior art method wherein only the bias voltage is adjustable. As can readily be understood from the graph of FIG. 2, the rate of change in both the light intensity and the bias voltage when the image adjusting dial is adjusted according to the present invention is smaller than that exhibited when the light intensity and the bias voltage are separately adjusted according to the prior art method.

As hereinbefore described, the prior art method wherein only the light intensity is adjusted has a problem in that strokes of characters tend to be reproduced undesirably thick in a low illumination area, whereas the prior art method wherein only the bias voltage is adjusted has a problem in that the concentration of the totally blackened area varies. Therefore, in order that the optimum image compensation to impart a contrast can be developed regardless of whether the original image as a whole is printed dark or whether it is printed light, the compensation of the image at a low illumination area is carried out by simultaneously adjusting the light intensity and the bias voltage because the image compensation relied on by the adjustment of only the light intensity is limited, the adjustment of the bias voltage being performed to such an extent that no harm will be brought to the compensation of the image at the low illumination area. On the other hand, the compensation of the totally blackened image is also carried out by simultaneously adjusting the light intensity and the bias voltage because the image compensation relied on by the adjustment of only the bias voltage is limited, the adjustment of the light intensity being performed to such an extent that no harm will be brought to the compensation of the totally blackened image. Accordingly, with respect to the image compensation relative to the low illumination area and that relative to the totally blackened area, a characteristic disadvantage of one of them relative to the change in light intensity and the change in bias voltage can be compensated for by the other of them.

In view of the foregoing, and referring to the graph of FIG. 2, the rate of change (gradient) is small as compared with the case wherein the light intensity and the bias voltage are independently adjusted. Since in the illustrated embodiment of the present invention the light intensity and the bias voltage are simultaneously adjusted to effect the image compensation, the compensation can be developed over a relatively large range as compared with the case wherein only the light intensity or the bias voltage is adjusted to effect the image compensation.

Figure 3:
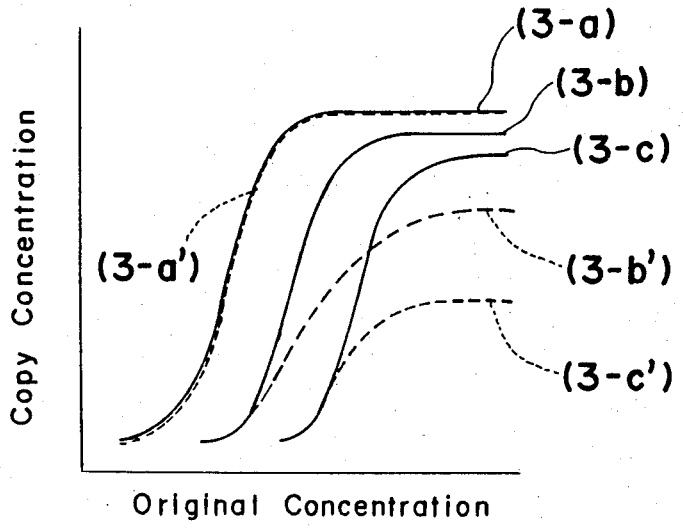

FIG. 3 shows a graph illustrating the relationships between the original concentration, i.e., the concentration of an image in the original, and the copy concentration, i.e., the concentration of a copied image on a copy paper, which are attained in the present invention and the prior art method wherein only the bias voltage is adjusted, respectively. In the graph of FIG. 3, the solid lines 3-*a*, 3-*b* and 3-*c* represent respective characteristics achieved in the present invention when the image adjusting dial is at the graduations No. 1, No. 3 and No. 5, whereas the broken lines 3-*a'*, 3-*b'* and 3-*c'* represent respective characteristics achieved by the prior art method. As can be readily understood from the graph of FIG. 3, in the present invention, even when the image adjusting dial is turned to any one of the graduations No. 3 and No. 5, the copy concentration will not be reduced so much as that according to the prior art method.

Figure 4:
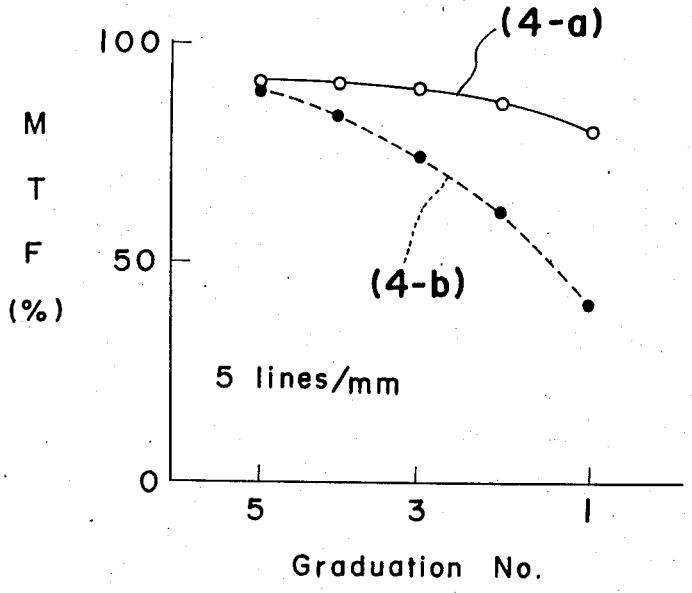

The graph of FIG. 4 illustrates the relationship between the modulation transfer function or MTF (%) of five lines per millimeter and the position of the image adjusting dial which has been attained by the method of the present invention and that attained by the prior art method wherein only the light intensity is adjusted. MTF is a response function descriptive of the sharpness of a copied image on the copy paper. The solid line 4-*a* represents the characteristic according to the present invention, whereas the broken line 4-*b* represents that according to the prior ar method. As can be understood from the graph of FIG. 4, according to the present invention, no substantial reduction occurs in MTF when the image adjusting dial is set at about the graduation No. 1, and accordingly, there is no possibility that strokes of characters will be reproduced with an undesired thickness.

Although the present invention has fully been described in connection with the preferred embodiment with reference to the accompanying drawings, it is to be noted that various changes and modifications are apparent to those skilled in the art. By way of example, although the present invention has been described as applied to the copying machine utilizing the double-layered photosensitive surface, it may equally apply to a copying machine utilizing a triple-layered photosensitive surface.

Such changes and modifications are to be understood as included within the scope of the present invention as defined by the appended claims, unless they depart therefrom.

What is claimed is:

1. An image compensating method in a copying machine comprising the steps of:
   - applying a bias voltage to a developer unit of the copying machine;
   - controlling the intesity of light to be projected at an exposure section of the copying machine; and
   - simultaneously adjusting both said bias voltage to be applied to the developer unit and the intensity of light to be projected at said exposure section onto a photosensitive medium.

2. The method of claim 1 wherein said copy machine comprises means for varying the bias voltage of the developer and means for controlling the intensity of the light projection at the exposure section, said means for varying including a first variable resistor, said means for controlling including a second variable resistor, said step of simultaneously adjusting including simultaneously varying said first and second variable resistors by constraining said resistors to move together.

3. In a copying machine wherein an object to be copied is reproduced as an image on a photosensitive medium, said copying machine having a rotating photoreceptor drum, an exposure section and a developer unit, a method of adjusting image intensity comprising:
   - applying a variable bias voltage to said developer unit;
   - controlling the intensity of light projected by said exposure section; and
   - simultaneously varying said bias voltage applied to said developer unit and the intensity of light projected by said exposure section so as to control image brightness while maintaining image contrast substantially constant.

4. The method of claim 3 wherein said step of controlling the intensity of light projected by said exposure section comprises varying the drive voltage supplied to a source of said light.

5. The method of claim 4 wherein the drive voltage supplied to said light and said bias voltage are both increased to intensify or darken said image.

6. The method of claim 3 wherein said copy machine comprises means for varying the bias voltage of the developer and means for controlling the intensity of the light projection at the exposure section, said means for varying including a first variable resistor, said means for controlling including a second variable resistor, said step of simultaneously adjusting including simultaneously varying said first and second variable resistors by constraining said resistors to move together.

7. A system for adjusting image intensity in a copying machine and wherein an object to be copied is reproduced as an image on a photosensitive medium, said copying machine including a rotary photoreceptor drum, an exposure section and a developer unit, said system comprising:
   - means for supplying a bias voltage to said developer unit;
   - means for developing the light projected by said exposure section; and
   - means for simultaneously varying said bias voltage developed by said supplying means and the intensity of light projected by said developing means.

8. The system of claim 7 wheein said means for developing includes a light source; and
   - said means for simultaneously varying includes:
     - a first variable resistor varying the bias voltage supplied said developer unit,
     - a second variable resistor varying a drive voltage to said light source,
     - means for operatively interconnecting said first and second variable resistors to constrain said resistors to move together.

* * * * *